United States Patent [19]

Marion

[11] 4,181,219

[45] Jan. 1, 1980

[54] CONTAINER HAVING PREMIUM-CONTAINING-AND-DISPENSING BOTTOM STRUCTURE AND METHOD AND APPARATUS FOR PROVIDING SAME

[75] Inventor: Thomas E. Marion, Baltimore, Md.

[73] Assignee: Maryland Cup Corporation, Owings Mills, Md.

[21] Appl. No.: 8,575

[22] Filed: Feb. 1, 1979

[51] Int. Cl.[2] ..... B65D 11/02

[52] U.S. Cl. ..... 206/217; 229/5.8

[58] Field of Search ..... 206/217, 139, 426, 427; 229/5.8, 5.5, 43; 220/23, 68, 256, 257, 306, 66

[56] References Cited

U.S. PATENT DOCUMENTS

| | | | |
|---|---|---|---|
| 1,020,187 | 3/1912 | Claussen | 229/5.5 |
| 1,798,339 | 3/1931 | Saulis | 206/217 |
| 2,174,618 | 10/1939 | Burdick | 220/23 |
| 2,563,352 | 8/1951 | Morse | 220/68 |
| 3,170,589 | 2/1965 | Winslow | 220/66 |
| 3,397,867 | 8/1968 | Hoff | 206/217 |
| 3,730,383 | 5/1973 | Dunn | 220/66 |
| 3,768,688 | 10/1973 | Linke | 220/23 |
| 3,920,120 | 11/1975 | Shveda | 206/217 |

*Primary Examiner*—Herbert F. Ross

*Attorney, Agent, or Firm*—Birch, Stewart, Kolasch and Birch

[57] ABSTRACT

A container is provided with a bottom curl configuration defining a secondary chamber and cooperating with a snap-in disc to hold a prize or premium between the disc and the bottom web of the container. The bottom curl is die-formed to include flattened areas or facets which act as detents to the disc but which, aesthetically, are substantially non-apparent.

4 Claims, 5 Drawing Figures

CONTAINER HAVING PREMIUM-CONTAINING-AND-DISPENSING BOTTOM STRUCTURE AND METHOD AND APPARATUS FOR PROVIDING SAME

FIELD OF THE INVENTION

This invention relates to disposable containers such as paper cups and the like and more particularly, to such containers having a bottom curl configuration which together with a removable disc or other insert forms a premium-retaining cavity beneath the bottom web of the container and to a method and apparatus for providing a premium-containing lower cavity in combination with the bottom curl of such a container.

BACKGROUND OF THE INVENTION

The use of the relatively small cavity beneath the bottom web of a frustoconical two-piece cup or the like for the purpose of holding a premium in conjunction with a friction-fitted retaining means such as an oversize disc frictionally forced into the cavity for the purpose of sandwiching a premium or prize between the disc and the bottom web of the container is known in the art. For example, such a container configuration is illustrated in U.S. Pat. No. 3,920,120 issued to Andrew P. Shveda on Nov. 18, 1975, and entitled "Combination Package." This patent shows various devices such as plastic films, foils and oversized friction-fit discs or snap-in discs for retaining a premium or prize in the cavity beneath the web of a container having a bottom curl configuration.

It is an object of the present invention to provide an improved snap-in disc and bottom curl configuration for containing a premium beneath the bottom web of a container.

The prior art has utilized such expedience as an annular trough for receiving in a snap-in manner an oversize disc or the like where the annular trough is formed by some suitable upsetting or die expressing process in the bottom curl of the cup or container. This creates a distinct problem since the conventional bottom curl configuration includes at least two and possibly three laminations of material by virtue of the folding of the sidewall portion of the container over and around an annular mating portion of the bottom web or bottom blank such that the free end of this bent or crimped sidewall re-enters the cavity formed beneath the bottom web portion of the container. Accordingly, there are three layers of material which must be upset or deformed in order to provide an annular feed for snapping in a premium-retaining disc in that lowermost cavity of such a container.

Accordingly, it is another object of the present invention to provide a snap-in disc and bottom curl configuration for premium retention beneath the bottom web of a container such that the snap-in effect is achieved with substantially no visual indication of an upset in the bottom curl of the container and which precludes the need to provide an annular feeding groove or the like for such a snap-in disc in the bottom curl.

These and other objects of the present invention will become more fully apparent with reference to the following specification and drawings which relate to a preferred embodiment of the invention.

SUMMARY OF THE INVENTION

A two-piece container such as a frustoconical drinking cup having a dependent annular bottom curl forming a secondary chamber beneath the bottom web of the container is die-formed to provide flattened peripheral portions or facets across cords of the arc of the bottom curl. These flattened portions or facets are most apparent at the extreme periphery of the bottom curl and are merged in a smooth continuous transition from that extreme periphery with the sidewall of the container adjacent the bottom web of the container. Since the indentations or flattened cords in the extreme periphery of the bottom curl effect a multi-faceted reduced diameter opening therein, a snap-in disc of a diameter less than or equal to the unformed bottom curl opening but greater than the narrowest portions of the die-formed reduced diameter opening can be snap-fitted within the secondary chamber. The relatively loose fit of the snap-in disc provides for its ready insertion and removal without requiring a tight or exact dimension fit while at the same time permitting the disc to retain a prize within the secondary chamber adjacent the bottom web. The primary chamber of the container is of course above the bottom web.

The smooth transitional nature of the flattened die-formed portions or facets in the bottom curl is substantially visually non-apparent since there is no eye-catching abruptness of contour effected in the bottom curl of the container. Thus, the snap-in disc is effective to hold a prize within the secondary chamber of the container without deformation or dimensional criticality thereof or visually apparent deformation of the bottom curl of the container. Therefore, a highly desirable commercial product is achieved by the present invention which has both functional integrity and aesthetic acceptability.

DETAILED DESCRIPTION OF THE DRAWINGS

Figure 1:
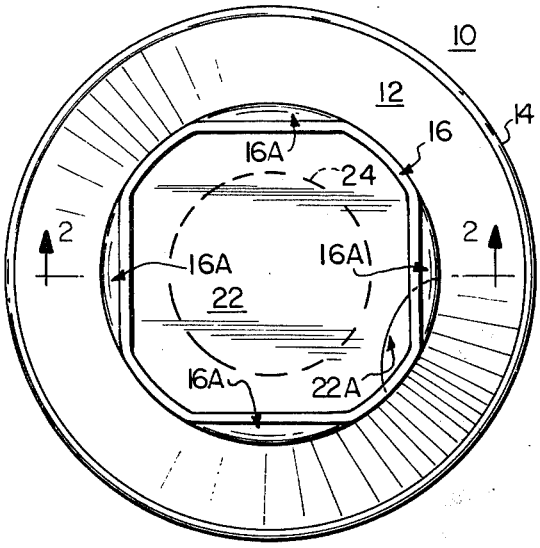
FIG. 1 is a bottom plan view of a container having a bottom curl configuration of the present invention.
Figure 2:
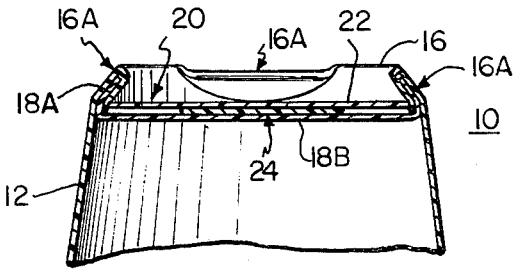
FIG. 2 is a cross-section taken along line 2—2 of FIG. 1.

Referring in detail to the drawings and with particular reference to FIGS. 1 and 2, a container 10 is illustrated as having a sidewall 12 extending from a top curl 14 adjacent the open mouth portion thereof to a bottom curl construction 16 which is interconnected with the dependent annular skirt portion 18A of a bottom disc or web 18B to form the closed end of the container 10.

Because the bottom curl configuration 16 extends beyond the bottom web portion 18B there is formed a secondary or bottom chamber 20 beneath the bottom web 18B of the container 10.

As illustrated in FIGS. 1 and 2, the bottom curl configuration 16 is basically annular but has four upset portions 16A formed therein, each comprising a flattened portion or facet extending across the cord of an arc defining the extreme periphery of the bottom curl of the container and in the case of the FIGS. 1 and 2 four such flattened portions or facets 16A arranged at 90° intervals around the circular arc defined by the outermost or extreme periphery of the bottom curl 16. The facets 16A extend from the straight line cord portions thereof in a smooth and continuous transition with the sidewall 12 at the point of intersection between it and the bottom web portion 18B of the container 10.

Aesthetically, these upset portions 16A, by virtue of their basically symmetrical appearance and the fact that the smooth and continuous transition thereof with the sidewall 12 effects a rather innocuous blend with the bottom curl configuration 16, provide a detent means in the bottom curl 16 which to the eye of the casual observer is substantially concealed. The configuration shown in FIGS. 1 and 2 is exaggerated for the sake of clarity of illustration and is not intended to depict a scale rendition of the relationship between the upset facets or portions 16A, the bottom curl configuration 16 and the snap-in disc 22 illustrated in position within the chamber 20 to be hereinafter more fully described.

Figure 5:
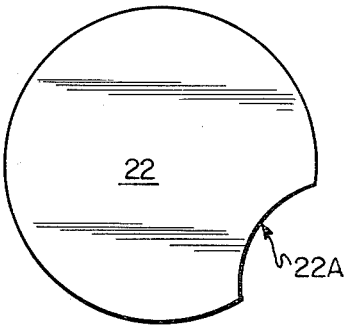
FIG. 5 is a top plan view of the snap-in disc configuration of the present invention.

Referring to FIG. 5, the snap-in disc 22 is illustrated as being of a circular disc configuration with an arcuate bite or relieved finger grip portion 22A formed in its outer periphery. This provides for the insertion of a finger or other object beneath the disc 22 by virtue of the relieved portion 22A, when the disc 22 is in position in the secondary chamber 20 of the container 10, to pop the disc 22 therefrom and permit access to a premium 24 or the like which is illustrated as sandwiched in place in FIG. 2 between the said disc 22 and the bottom web 18B.

Figure 3:
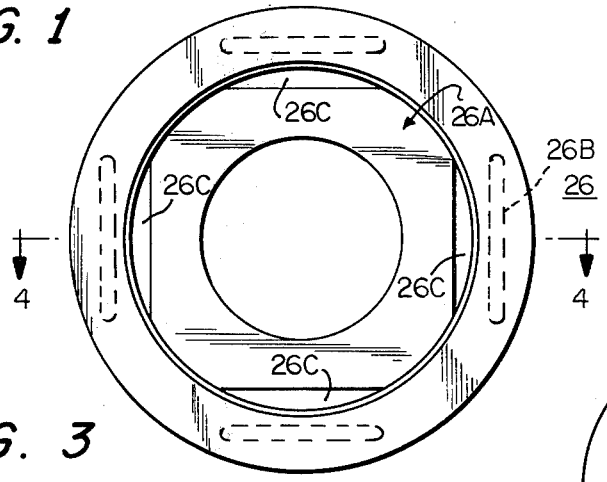
FIG. 3 is a bottom plan view of a female die member for forming a bottom curl configuration of the present invention.
Figure 4:
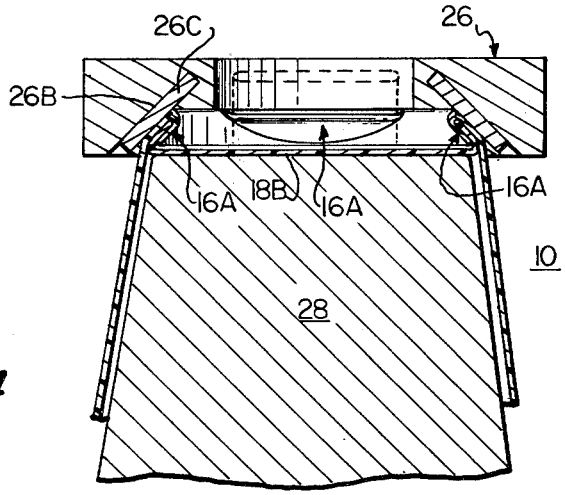
FIG. 4 is a cross-section taken along line 4—4 of FIG. 3 and including a cross-section of a container of the present invention and a male die member all cooperating with the female die member of FIG. 3.

FIGS. 3 and 4 illustrate a die 26 having an annular chamber 26A therein for receiving the lowermost end of the container 10 to form the upset portions or facets 16A in the bottom curl configuration 16 as illustrated in FIG. 4. The die 26 is provided with four inclined slots 26B into which are inserted steel rule sections 26C, the steel rule sections extending outwardly into the annular die cavity 26A to provide surfaces conforming to the shape of the desired upset portions or facets 16A in the bottom curl configuration 16.

A male die member 28 which is of frustoconical configuration or otherwise conformally shaped with respect to the interior of the container 10 is inserted into the container 10 such that the bottom web 18B is firmly supported thereby and then the male and female die member 28 and 26, respectively, are merged to cause the steel rules 26C to engage the bottom curl configuration 16 and constrain it to assume upset portions 16A at the 90° positions corresponding to the locations of the steel rule surfaces 26C.

This upsetting operation of the bottom curl configuration 16 is of a type which may be performed on a turret with a plurality of dies or the like and is achievable in a very rapid high-speed mode of operation.

In the operation of inserting and removing the premium to and from the secondary chamber 20 of the container 10, the premium 24 is inserted into the chamber 20 once the bottom curl 16 has been upset to form the uniformly placed upset portions or facets 16A and then the snap-in disc 22, which may be loosely dimensioned with respect to the size of the bottom web portion 18B, is snapped into the chamber 20 where it gently retains the premium 24 in place by its cooperative engagement with the internal surfaces of the upset portions or facets 16A in the bottom curl 16.

At the point of purchase of the container 10 with any suitable contents to be dispensed therein, the customer can remove his premium 24 by inserting his finger or other object into the arcuate detent portion 22A, which is located as shown in FIG. 1, and pop the disc 22 from the chamber 20 to thereby provide access to the premium 24 contained between the said disc 22 and the bottom web portion 18B of the container 10.

Thus it can be seen that a facile and unique bottom curl configuration and secondary chamber has been provided for containers for the purpose of retaining premiums or articles therein by a snap-in disc or the like. The advantage over the prior art is that the deformation practice upon the bottom curl configuration is relatively simple and rapid to achieve and does not unduly distort or deface, aesthetically, the bottom curl configuration of the container itself and at the same time provides a means whereby the disc to be inserted by snapping into the bottom cavity need not be dimensioned to tightly fit with the container but may loosely snap into place due to the multi-point retention provided by the upset portions or facets in the bottom curl. This loose fit provides for ready removal but precludes accidental removal. Also, in disposable containers and the like, the ability to provide a desired result without undue restriction as to close tolerances permits high production speeds without a loss of quality which is most important in commercial operations.

The aesthetics of the upset portions or facets 16A has been found to be a substantially non-apparent physical change in the bottom curl configuration such that there is no diminishment of aesthetic value of the container where the bottom curl has been upset by the method of the present invention to form the configuration of the present invention.

It should be understood that the CONTAINER HAVING PREMIUM-CONTAINING-AND-DISPENSING BOTTOM STRUCTURE AND METHOD AND APPARATUS FOR PROVIDING SAME of the present invention may be modified as would occur to one of ordinary skill in the art without departing from the spirit and scope of the present invention.

It is claimed:

1. In a container having a annular sidewall and a bottom web forming a primary product chamber therein, and an annular bottom curl forming a secondary chamber with said bottom web, an improved means for removably retaining an article in said secondary chamber, comprising:

a plurality of flattened areas extending along a cord of arc of the extreme periphery of said annular bottom curl and extending from said extreme periphery in a smooth transition with said sidewall to a position adjacent said bottom web to define a multi-faceted access opening to said secondary chamber; and a disc sized to snap-in to said secondary chamber through said multi-faceted opening for retaining an article in said secondary chamber adjacent said bottom web.

2. The invention defined in claim 1, wherein said flattened areas in said bottom curl configuration are so proportioned as to be substantially non-apparent to an observer while providing a plurality of facets loosely engageable with said disc for detaining said disc from accidental removal from said secondary chamber.

3. The invention defined in claim 1, wherein said disc includes a relieved peripheral portion engageable for selective removal of said disc from said secondary chamber.

4. The invention defined in claim 3, wherein said flattened areas in said bottom curl configuration are so proportioned as to be substantially non-apparent to an observer while providing a plurality of facets loosely engageable with said disc for detaining said disc from accidental removal from said secondary chamber.

* * * * *